US008651729B2

(12) United States Patent
Tsai et al.

(10) Patent No.: US 8,651,729 B2
(45) Date of Patent: Feb. 18, 2014

(54) TURBINE VIBRATOR

(75) Inventors: Tzu-Chuan Tsai, Tucheng (TW); Chung-Wei Lu, Tucheng (TW); Chao-Kai Cheng, Tucheng (TW)

(73) Assignee: Kuei-Yung Wu, New Taipei (TW)

( * ) Notice: Subject to any disclaimer, the term of this patent is extended or adjusted under 35 U.S.C. 154(b) by 783 days.

(21) Appl. No.: 12/881,536

(22) Filed: Sep. 14, 2010

(65) Prior Publication Data

US 2012/0063260 A1 Mar. 15, 2012

(51) Int. Cl.
*B01F 11/00* (2006.01)
*B06B 1/18* (2006.01)

(52) U.S. Cl.
USPC ..... 366/124; 415/214.1

(58) Field of Classification Search
USPC ..... 366/124, 125, 128; 415/202, 203, 214.1
See application file for complete search history.

(56) References Cited

U.S. PATENT DOCUMENTS 1,346,221 A * 7/1920 Liedtke ..... 366/124
2,875,988 A * 3/1959 Wysong ..... 366/124
3,191,911 A * 6/1965 Bodine, Jr. ..... 366/124
3,870,282 A * 3/1975 Wadensten ..... 366/124
3,932,057 A * 1/1976 Wadensten ..... 366/124
3,938,905 A * 2/1976 Wadensten ..... 415/119
4,604,029 A * 8/1986 Fink ..... 415/92
5,314,305 A * 5/1994 Fink ..... 415/202
6,244,815 B1 * 6/2001 Treat ..... 415/54.1
6,966,751 B2 * 11/2005 Masterson et al. ..... 415/119
2001/0004438 A1 * 6/2001 Reis ..... 415/202
2012/0063260 A1 * 3/2012 Tsai et al. ..... 366/124

FOREIGN PATENT DOCUMENTS

GB 1359087 * 7/1974

* cited by examiner

*Primary Examiner* — Charles E Cooley
(74) *Attorney, Agent, or Firm* — Rabin & Berdo, P.C.

(57) ABSTRACT

A turbine vibrator has a housing, an eccentric rotor mounted in an air chamber of the housing and two covers mounted respectively in two mounting recesses of the housing. Two threaded walls defined respectively around the mounting recesses of the housing have same threaded directions. Therefore, the mounting recesses, the air chamber and the other mounting recess are formed sequentially so axes of the mounting recesses and the air chamber are disposed along a same line. Manufacturing processes of the housing is reduced and shearing forces applied to the shafts of the eccentric rotor are reduced so the turbine vibrator has a prolonged useful life. Moreover, as a rotating direction of the eccentric rotor and the fastening directions of the covers are the same, when the turbine vibrator operates, the covers tighten against the housing. The first and second covers do not drop from the housing.

12 Claims, 6 Drawing Sheets

TURBINE VIBRATOR

BACKGROUND OF THE INVENTION

1. Field of the Invention

The present invention relates to a turbine vibrator, especially to a turbine vibrator that has an unbalanced rotor driven by gas momentum so the turbine vibrator vibrates with a specific frequency when the rotor rotates.

2. Description of the Prior Art(s)

A turbine vibrator is mounted on a device, such as a storehouse, a stirring apparatus, a pulverizer and the like. A high-pressure gas flows into the turbine vibrator to push an eccentric rotor. As a radial momentum of the eccentric rotor changes, the eccentric rotor as well as the turbine vibrator and the device vibrate. Thus, grains stuck on a wall or in a corner or an aperture of the device are shaken out.

With reference to FIG. 5, a conventional turbine vibrator 60 comprises a housing 61, an eccentric rotor 62, two bearings 63 and two covers 64.

The housing 61 has two mounting recesses 611, two inner peripheral walls, and an air chamber 612. The mounting recesses 611 are formed respectively in two opposite side surfaces of the housing 61. The inner peripheral walls are defined respectively around the mounting recesses 611 and are threaded. The air chamber 612 is formed through the housing 61 and is defined between and communicates the mounting recesses 611.

The eccentric rotor 62 is mounted in the air chamber 612 of the housing 61 and has two shafts 621 respectively protruding from two opposite side surfaces of the eccentric rotor 62. The bearings 63 are mounted respectively on the shafts 621 of the eccentric rotor 62.

The covers 64 are respectively mounted securely in the mounting recesses 611 of the housing 61. Each cover 64 has a peripheral wall and a pivot recess 641. The peripheral wall of the cover 64 is defined around the eccentric rotor 62, is threaded and engages a corresponding inner peripheral wall of the housing 61. The pivot recess 641 is formed in an inner surface of the cover 64 and is mounted around a corresponding bearing 63.

To manufacture the housing 10 by a lathe, a through hole is formed firstly through the housing 61 and has an internal diameter the same as an internal diameter of the air chamber 612. Then a carriage of the lathe is moved toward one side surface of the housing 61 and forms one of the mounting recesses 611 of the housing 61 and a corresponding threaded inner peripheral wall. Afterwards, the housing 10 is turned over and the other mounting recess 611 and a corresponding threaded peripheral wall are formed.

However, under a manufacturing function as described, axes of the mounting recesses 611 of the housing 61 are not easily aligned. Thus, positions of the covers 64 and the shafts 621 of the eccentric rotor 62 are offset. Consequently, as the eccentric rotor 62 rotates, the shafts 621 of the eccentric rotor 62 endure shearing force and fracture easily. Furthermore, while additional reference positions are needed when holding the housing 61 in specific positions with jigs, manufacturing processes to the housing 61 is lengthy.

With further reference to FIG. 6, moreover, threaded directions of the inner peripheral wall are reversed. Consequently, fastening directions of the covers 64 are also reversed. Therefore, when the conventional turbine vibrator 60 operates and the eccentric rotor 62 rotates in a specific direction to vibrate the conventional turbine vibrator, one of the covers 64 gets tighter to the housing 61 and the other one of the covers 64 gets looser and may even drop from the housing 61.

To overcome the shortcomings, the present invention provides a turbine vibrator to mitigate or obviate the aforementioned problems.

SUMMARY OF THE INVENTION

The main objective of the present invention is to provide a turbine vibrator. The turbine vibrator has a housing, an eccentric rotor mounted in an air chamber of the housing and two covers mounted respectively in two mounting recesses of the housing. Two threaded walls defined respectively around the mounting recesses of the housing have same threaded directions.

Therefore, the mounting recesses, the air chamber and the other mounting recess are formed sequentially so axes of the mounting recesses and the air chamber are disposed along a same line. Manufacturing processes of the housing is reduced and shearing forces applied to the shafts of the eccentric rotor are reduced so the turbine vibrator has a prolonged useful life.

Moreover, as a rotating direction of the eccentric rotor and the fastening directions of the covers are the same, when the turbine vibrator operates, the covers tighten against the housing. The first and second covers do not drop from the housing.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
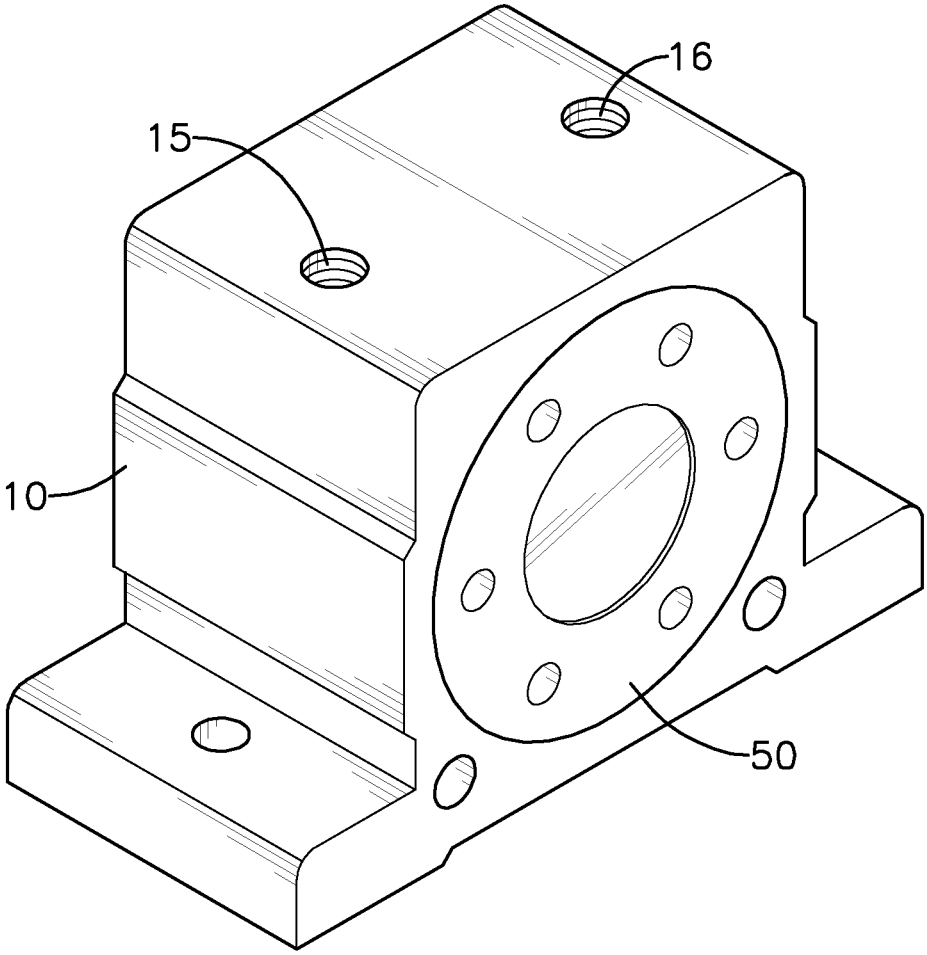
FIG. 1 is a perspective view of a turbine vibrator in accordance with the present invention.
Figure 2:
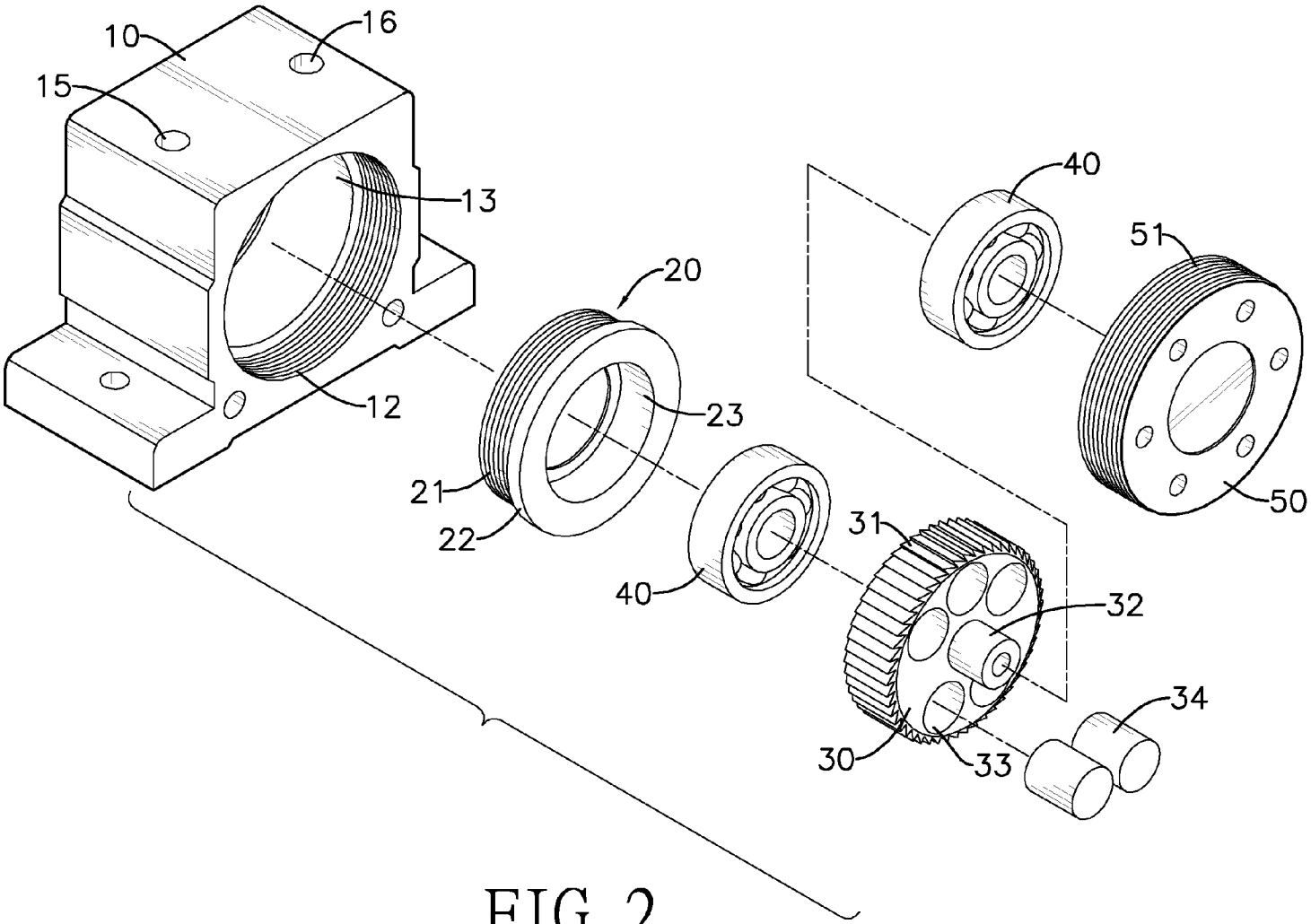
FIG. 2 is an exploded perspective view of the turbine vibrator in FIG. 1.

With reference to FIGS. 1 and 2, a turbine vibrator in accordance with the present invention comprises a housing 10, a first cover 20, an eccentric rotor 30, two bearings 40 and a second cover 50.

Figure 3:
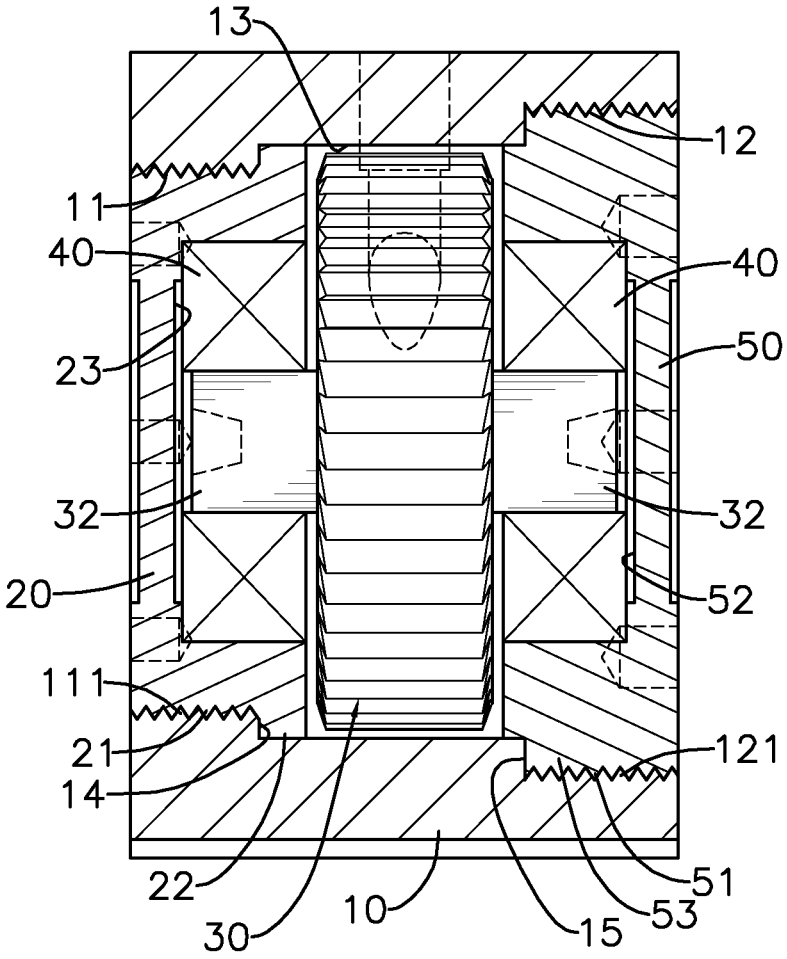
FIG. 3 is a side view in partial section of the turbine vibrator in FIG. 1.

With further reference to FIG. 3, the housing 10 has two opposite side surfaces, a first mounting recess 11, a first threaded wall 111, a second mounting recess 12, a second threaded wall 121, an air chamber 13, a chamber wall, a first shoulder 14, a second shoulder 15, at least one air inlet 15 and at least one air outlet 16.

The first mounting recess 11 is formed in one of the side surfaces of the housing 10 and has an internal diameter. The first threaded wall 111 is defined around the first mounting recess 11.

Figure 4:
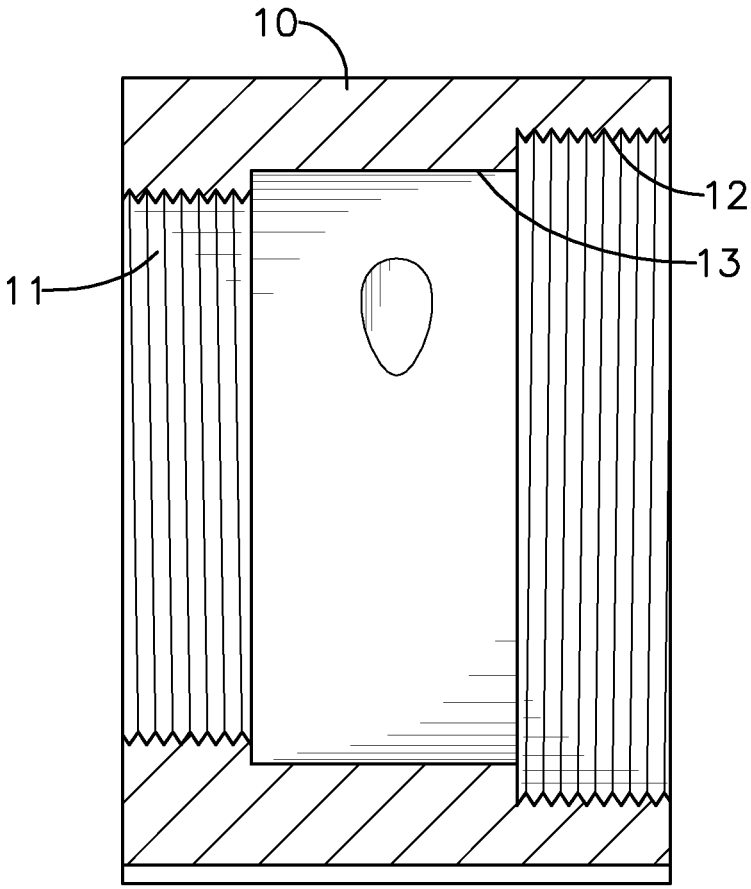
FIG. 4 is a cross-sectional side view of a housing of the turbine vibrator in FIG. 1.
Figure 5:
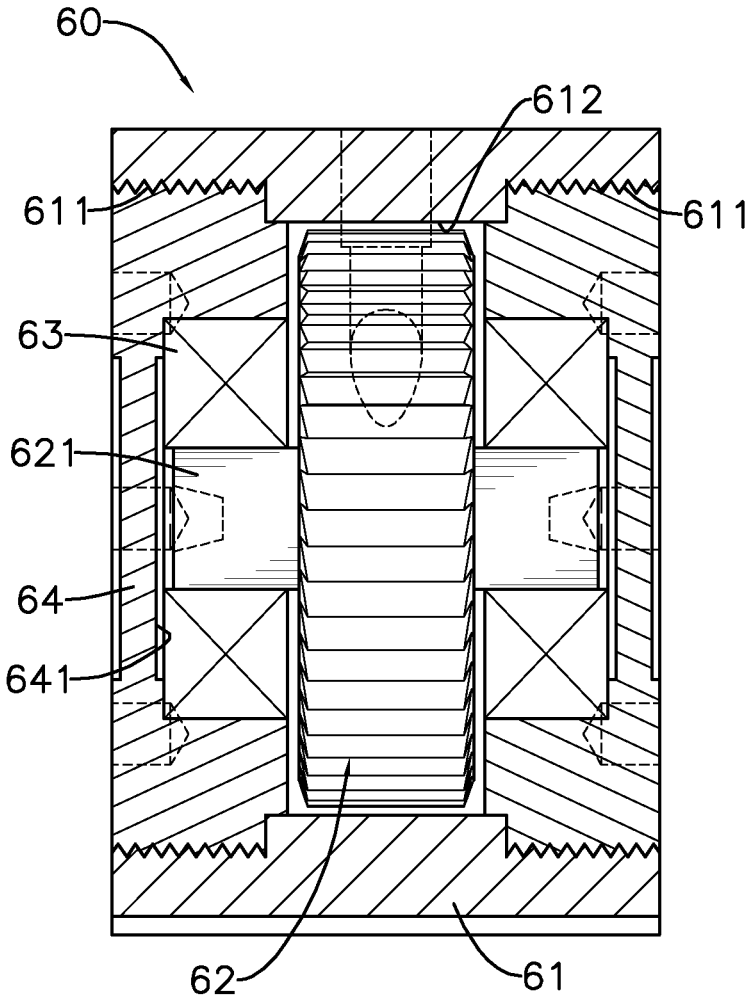
FIG. 5 PRIOR ART
FIG. 5 is a side view in partial section of a conventional turbine vibrator in accordance with the prior art.
Figure 6:
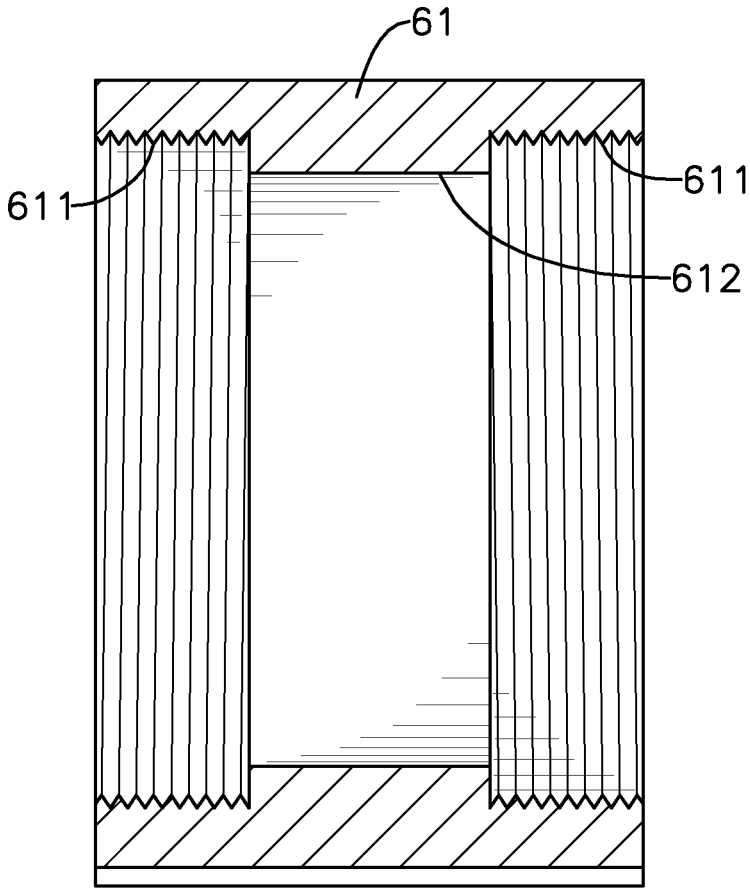
FIG.6 PRIOR ART
FIG. 6 is a cross-sectional side view of a housing of the turbine vibrator in FIG. 5.

With further reference to FIG. 4, the second mounting recess 12 is formed in the other one of the side surfaces of the housing 10 and has an internal diameter. The internal diameter of the second mounting recess 12 is larger than the internal diameter of the first mounting recess 11. The second threaded wall 121 is defined around the second mounting recess 12 and has a threaded direction the same as a threaded direction of the first threaded wall 111.

The air chamber 13 is formed through the housing 10, is disposed between and communicates with the first and second mounting recesses 11, 12 and has an internal diameter. The internal diameter of the air chamber 13 is larger than the internal diameter of the first mounting recess 11 and is smaller than the internal diameter of the second mounting recess 12. The chamber wall is defined around the air chamber 13. The first shoulder 14 is defined between the first threaded wall 111 and the chamber wall. The second shoulder 15 is defined between the chamber wall and the second threaded wall 121.

The at least one air inlet 15 and the at least one air outlet 16 are formed separately through the housing 10 and communicate with the air chamber 13.

The first cover 20 is mounted into the housing 10, is disposed securely in the first mounting recess 11 of the housing 10 and has a threaded wall 21, a flange 22, a pivot recess 23 and a fastening direction. The threaded wall 21 of the first cover 20 is formed around the first cover 20 and is screwed onto the first threaded wall 111 of the housing 10 so the first cover 20 is securely held in the housing 10. The flange 22 of the first cover 20 is formed around the first cover 20 adjacent to an inner end of the first cover 20 and abuts the first shoulder 14 of the housing 10. The pivot recess 23 of the first cover 20 is formed in the inner end of the first cover 20.

The eccentric rotor 30 is mounted rotatably in the air chamber 13 of the housing 10 and has multiple ratchets 31, two shafts 32, multiple through holes 33, at least one insert 34 and a center of gravity. The ratchets 31 are formed around the eccentric rotor 30 so the eccentric rotor 30 is propelled to rotate in a predetermined direction. The rotating direction of the eccentric rotor 30 is the same as the fastening direction of the first cover 20. The shafts 32 protrude respectively from two opposite side surfaces at a center of the eccentric rotor 30. The through holes 33 are formed separately through the eccentric rotor 30. Distances defined between each two through holes 33 may not be the same. The at least one insert 34 is mounted in one of the through holes 33 to change the center of gravity of the eccentric rotor 30.

In other preferred embodiments, the eccentric rotor 30 may be manufactured with different kinds of materials in different positions, or the eccentric rotor 30 may be manufactured with a kind of material and have different densities in different positions so the center of gravity and the shafts 32 of the eccentric rotor 30 are disposed in different positions.

The bearings 40 may be rolling-element bearings such as ball bearings or roller bearings, or fluid bearings such as gas bearings or oil bearings, are mounted respectively on the shafts 32 and one of the bearings 40 is disposed in the pivot recess 23 of the first cover 20.

The second cover 50 is disposed securely in the second mounting recess 12 of the housing 10 and has a threaded wall 51, a flange 53, a pivot recess 52 and a fastening direction. The threaded wall 51 of the second cover 50 is formed around the second cover 50 and is screwed onto the second threaded wall 121 of the housing 10 so the second cover 50 is securely held in the housing 10. The flange 53 of the second cover 50 is formed around the second cover 50 adjacent to an inner end of the second cover 50 and abuts the second shoulder 15 of the housing 10. The pivot recess 52 of the second cover 50 is formed in the inner end of the second cover 50 and is mounted around the other one of the bearings 10 that corresponds to the pivot recess 52 of the second cover 50. The fastening direction of the second cover 50 is the same as the fastening direction of the first cover 20 and the rotating direction of the eccentric rotor 30.

When a high-pressure gas flows into the air chamber 13 through the air inlet 15 of the housing 10, the high-pressure gas pushes the ratchets 31 of the eccentric rotor 30 to rotate the eccentric rotor 30 and then flows out of the housing 10 through the air outlet 16 of the housing 10. Since the center of gravity and the shaft 32 of the eccentric rotor 30 misalign with each other, the eccentric rotor 30 vibrates as a radial momentum of the eccentric rotor 30 changes. Consequently, a device having the turbine vibrator vibrates and shakes grains stuck on the device.

The turbine vibrator as described has the following advantages. Since the threaded direction of the first and second threaded walls 111, 121 of the housing 10 are the same, when manufacturing the housing 10 with a lathe, a through hole having an internal diameter the same as the first mounting recess 11 is formed first. Then the first threaded wall 111, the air chamber 13, the second mounting recess 12 and the second threaded wall 121 of the housing 10 are formed sequentially. Thus, axes of the first and second mounting recesses 11, 12 and the air chamber 13 are disposed along a same line. Shearing forces applied to the shafts 32 of the eccentric rotor 30 is reduced so the turbine vibrator has a prolonged useful life.

Moreover, as the ratchets 31 of the rotor 30 are extended obliquely toward the specific direction so the eccentric rotor 30 has a specific rotating direction the same as the fastening directions of the first and second covers 20, 50, when the turbine vibrator operates and the eccentric rotor 30 rotates to vibrate the turbine vibrator, the first and second covers 20, 50 are getting tighter to the housing 10. Therefore, the first and second covers 20, 50 are not dropped from the housing 10.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A turbine vibrator comprising:

a housing having two opposite side surfaces;

a first mounting recess formed in one of the side surfaces of the housing and having an internal diameter;

a first threaded wall defined around the first mounting recess;

a second mounting recess formed in the other one of the side surfaces of the housing and having an internal diameter larger than the internal diameter of the first mounting recess;

a second threaded wall defined around the second mounting recess and having a threaded direction the same as a threaded direction of the first threaded wall;

an air chamber formed through the housing, disposed between and communicating with the first and second mounting recesses and having an internal diameter larger than the internal diameter of the first mounting recess and smaller than the internal diameter of the second mounting recess;

a chamber wall defined around the air chamber;

a first shoulder defined between the first threaded wall and the chamber wall;

a second shoulder defined between the chamber wall and the second threaded wall;

at least one air inlet and at least one air outlet formed separately through the housing and communicating with the air chamber;

a first cover disposed securely in the first mounting recess of the housing and having a pivot recess formed in an inner end of the first cover;

an eccentric rotor mounted rotatably in the air chamber of the housing and having multiple ratchets formed around the eccentric rotor; and two shafts protruding respectively from two opposite side surfaces at a center of the eccentric rotor;

two bearings mounted respectively on the shafts and one of the bearings disposed in the pivot recess of the first cover; and a second cover disposed securely in the second mounting recess of the housing and having a pivot recess formed in an inner end of the second cover and mounted around the other one of the bearings that corresponds to the pivot recess of the second cover.

2. The turbine vibrator as claimed in claim 1, wherein the eccentric rotor is propelled to rotate in a predetermined direction the same as fastening directions of the first and second covers.

3. The turbine vibrator as claimed in claim 2, wherein the eccentric rotor further has multiple through holes formed separately through the eccentric rotor; and at least one insert mounted in one of the through holes of the eccentric rotor.

4. The turbine vibrator as claimed in claim 3, wherein distances defined between each two through holes of the eccentric rotor are not the same.

5. The turbine vibrator as claimed in claim 2, wherein any one of the two bearings is selected from the group consisting of a ball bearing, a roller bearing, a gas bearing and an oil bearing.

6. The turbine vibrator as claimed in claim 1, wherein the first cover is mounted into the housing and further has a flange formed around the first cover adjacent to the inner end of the first cover and abutting the first shoulder of the housing; and the second cover further has a flange formed around the second cover adjacent to the inner end of the second cover and abutting the second shoulder of the housing.

7. The turbine vibrator as claimed in claim 6, wherein the eccentric rotor further has multiple through holes formed separately through the eccentric rotor; and at least one insert mounted in one of the through holes of the eccentric rotor.

8. The turbine vibrator as claimed in claim 7, wherein distances defined between each two through holes of the eccentric rotor are not the same.

9. The turbine vibrator as claimed in claim 6, wherein any one of the two bearings is selected from the group consisting of a ball bearing, a roller bearing, a gas bearing and an oil bearing.

10. The turbine vibrator as claimed in claim 1, wherein the eccentric rotor further has multiple through holes formed separately through the eccentric rotor; and at least one insert mounted in one of the through holes of the eccentric rotor.

11. The turbine vibrator as claimed in claim 10, wherein distances defined between each two through holes of the eccentric rotor are not the same.

12. The turbine vibrator as claimed in claim 1, wherein any one of the two bearings is selected from the group consisting of a ball bearing, a roller bearing, a gas bearing and an oil bearing.

* * * * *